US006006733A

United States Patent [19]

Oleksiewicz

[11] Patent Number: 6,006,733

[45] Date of Patent: Dec. 28, 1999

[54] EXHAUST GAS RECIRCULATION APPARATUS

[75] Inventor: Radek A. Oleksiewicz, Riverwoods, Ill.

[73] Assignee: Navistar International Transportation, Chicago, Ill.

[21] Appl. No.: 09/168,520

[22] Filed: Oct. 8, 1998

[51] Int. Cl.[6] ..... F02M 25/07

[52] U.S. Cl. ..... 123/568.26; 123/568.21

[58] Field of Search ..... 123/568.11, 568.12, 123/568.2, 568.21, 568.22, 568.23, 568.24, 568.25, 568.26, 568.27, 568.28, 568.29; 60/278, 279, 605.2

[56] References Cited

U.S. PATENT DOCUMENTS

| | | | |
|---|---|---|---|
| 3,530,843 | 9/1970 | Fessenden | 123/568.11 |
| 4,142,492 | 3/1979 | Kobayashi et al. | 123/568.11 |
| 4,249,374 | 2/1981 | Sugasawa et al. | 60/278 |
| 4,350,013 | 9/1982 | Yoshiba | 123/568.2 |
| 4,506,633 | 3/1985 | Britsch | 123/568.11 |
| 4,969,445 | 11/1990 | Hertweck . | |
| 5,511,531 | 4/1996 | Cook et al. | 123/568.21 |
| 5,562,086 | 10/1996 | Asada et al. | 123/568.21 |
| 5,762,051 | 6/1998 | Okamoto | 123/568.2 |
| 5,911,681 | 6/1999 | Tanaka et al. | 123/568.21 |

*Primary Examiner*—Willis R. Wolfe

*Attorney, Agent, or Firm*—Dennis K. Sullivan; Jeffrey P. Calfa

[57] ABSTRACT

An exhaust gas recirculation flow control apparatus is proposed for use in an exhaust gas recirculation system of an electronically controlled engine where flow from each of two exhaust manifold banks converges into a common area incorporating a port therein communicating to a passageway of an intake manifold with flow from each of the exhaust banks being balanced. The valve seat in the valve housing port and the valve body are tapered to provide a side seal of the valve body and the tapered seat as the valve is moved linearly into the port from the exhaust manifold side to isolate the banks from one another, as well as to control flow through the communication port under direction of an ECU.

9 Claims, 1 Drawing Sheet

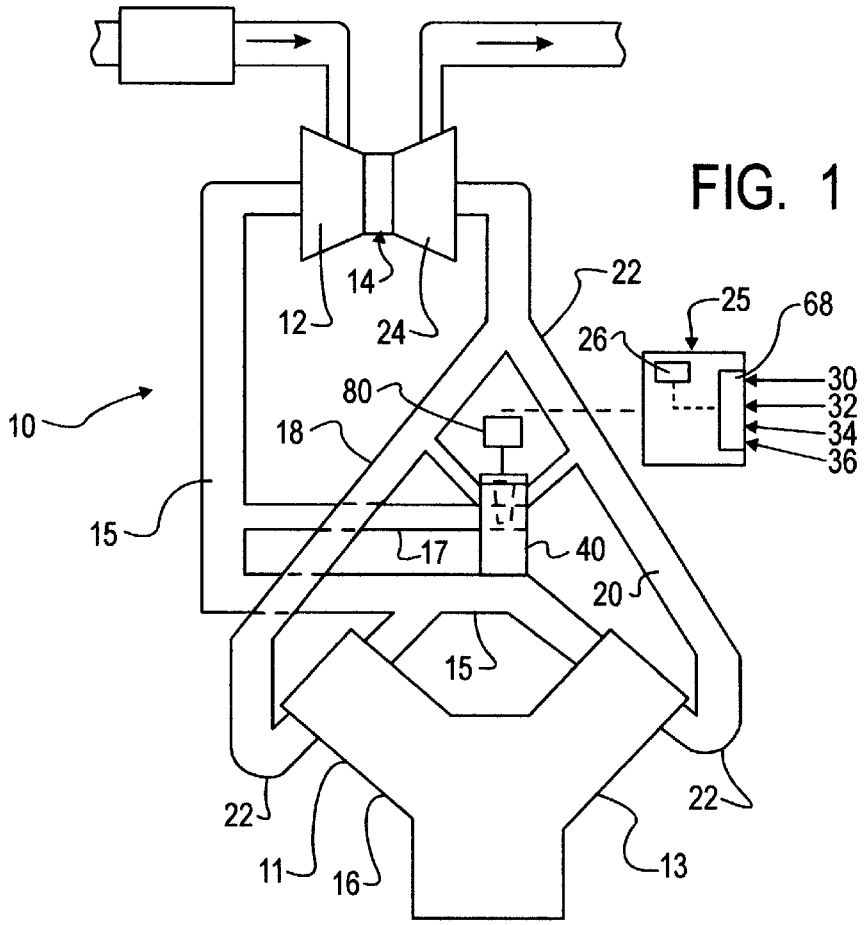
FIG. 1
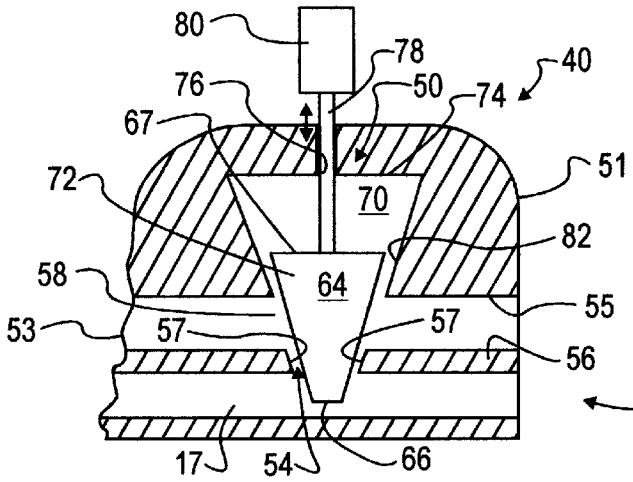
FIG. 2
FIG. 3
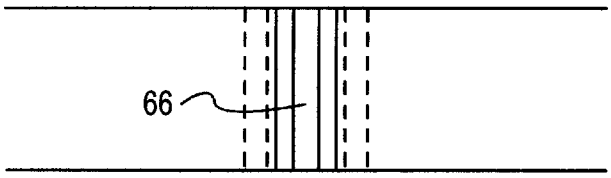

EXHAUST GAS RECIRCULATION APPARATUS

BACKGROUND OF THE INVENTION

The present invention relates to relates to internal combustion engines, particularly engines of the V-type having two banks of cylinders, and more particularly, to apparatus for controlling exhaust gas recirculation(EGR). More specifically, the apparatus of the present invention includes a three-way valve housing having a pair of exhaust inlets supplied respectively from first and second side banks converging in a common exhaust inlet port, an exhaust outlet to the intake manifold, and a tapered valve seat, a valve having a tapered head seating in the valve wherein the body of the valve extends across the common area and isolates the banks from one another, avoiding cross talk therebetween upon closure of the valve, the apparatus being operable by an ECU of the engine to produce a maximal instantaneous level of balanced recirculation without compromising optimal performance of the engine and without need of dedicated feedback for operability of the apparatus.

THE PRIOR ART

Heretofore, numerous embodiments of apparatus for controlling exhaust gas recirculation have been proposed. Of particular interest is U.S. Pat. No. 4,969,445 which discloses a twin flow exhaust manifold arrangement wherein the common port between the exhaust inlet side and the intake manifold side is closed by a valve disk. The valve head extends into the exhaust manifold port to partially separate exhaust flow between the exhaust manifolds. The extended portion of the valve head is shown in the drawings to have taper-like surfaces, perhaps to facilitate smooth flow through the port.

However, this twin flow exhaust arrangement does not provide a complete closure between the exhaust manifolds.

SUMMARY OF THE INVENTION

Accordingly, it is a primary object of the invention to provide an internal combustion engine having apparatus for controlling exhaust gas recirculation in a manner where optimal engine performance is not compromised, with the flow of exhaust gas entering an engine intake manifold from the exhaust manifolds of each of two banks of an engine, the exhaust manifolds of the banks being completely isolated from one another by the body of the control valve of the apparatus and with appropriate valve actuation under ECU control providing a maximal instantaneous level of recirculation without compromising optimal engine performance.

This object, as well as others which may become more apparent hereinafter, is specifically met by the EGR control apparatus of the present invention for an internal combustion engine of the V-type having two banks of cylinders, each bank having a source of exhaust flow which engages a respective inlet port in a three-way valve housing having a common outlet connected to an intake manifold and a tapered valve seat, and a valve having a tapered body for engaging said tapered valve seat, the valve body extending across the exhaust side of the housing when closed to isolate the exhaust bank flow paths from each other while sealing the inlet port, and being retractable to allow opening of the port in response to signals generated by an ECU of the engine with the flow area increasing geometrically as the retraction increases.

BRIEF DESCRIPTION OF THE DRAWINGS

FIG. 1 is a simplified diagram of an exemplary exhaust gas recirculation system of engine of V-type configuration incorporating the EGR control apparatus and valve of the present invention;

FIG. 2 is a cross-section through the valve and valve housing of the present invention; and FIG. 3 is an end view of the valve shown in FIG. 2.

DESCRIPTION OF THE PREFERRED EMBODIMENT

Referring now to the drawings in greater detail, there is illustrated in FIG. 1 a schematically exemplary embodiment of a turbocharged internal combustion engine 16 having an exhaust gas recirculation system generally identified by the reference numeral 10. The engine 16 is of V-type configuration having left and right banks of cylinders 11, 13.

Typically, pressurized air from a compressor 12 of a turbocharger 14 enters a common intake manifold 15 feeding into both banks of the engine 16 where air mixes with fuel which, when compressed by piston action, undergoes combustion, with chemical remnants of combustion, such as NOx, being carried away from the engine 16 via an exhaust manifold 22 of the engine 16 disposed on each bank 11, 13, the exhaust manifolds 22 feeding first and second passages 18 and 20, respectively, connected to a turbine 24 of the turbocharger 14 which drivingly engages the compressor 12 thereof.

To remove the NOx from the engine exhaust gas, such exhaust gas is preferably recirculated back through EGR valve 40 and passage 17 into the intake manifold 15, directly or indirectly, and is reburned, the instantaneous amount of exhaust gas capable of being accommodated for recirculation without compromising optimal engine 16 performance being dependent upon operational parameters of the engine 16 monitored by an ECU 25 thereof. In this respect, if there is an excessive amount of exhaust gas being recirculated into the intake manifold 15, it will cause the engine 16 to operate at a level of performance which is less than optimal, as well as potentially causing damage thereto.

Consequently, the amount of exhaust gas to be recirculated (level of recirculation) is controlled by the ECU 25 in response to sensed operational parameters of the engine 16 as compared to those required for optimal engine 16 performance. The ECU 25 analyzes readings received from various engine sensors, compares the readings to parameter values stored in a memory 26 thereof which are predetermined to produce optimal engine 16 performance and causes necessary actions in various devices controlled thereby to maintain the engine 16 at an optimal level of performance. Specific sensors which could be used in establishing appropriate control of exhaust gas recirculation could be, as an example, one or more of an intake manifold temperature sensor 30, a mass air flow sensor 32, an engine speed sensor 34 and a pedal position sensor 36

A tapered valve 50 incorporated into the exhaust gas recirculation control apparatus 40 disclosed herein has been designed to be operable under control of the ECU 25, in a predefined manner, in response to readings of parameters already being monitored by the ECU 25, instantaneously, without requiring a dedicated sensor or feedback circuit for appropriate activation thereof.

Turning now to FIGS. 2 and 3, a valve housing 51 has a first exhaust inlet port 53 connected to the left bank exhaust passage 18 and a second exhaust inlet port 55 connected to the right bank exhaust passage 20 and an outlet passage 17 leading to the intake manifold 15. A port 54, having a tapered valve seat 57 narrowing toward the outlet passage 17, is disposed in a wall 56 between the adjacent common portion 58 of the exhaust inlet passage and the outlet passage 17. Thus, the port 54 extending through the common wall 56 communicates each of the exhaust passages 18 and 20 with the intake manifold passage 17. The body 64 of the valve 50 is configured in a trapezoidal shape as shown, with the tip 66 thereof being narrower than the port 54, so that at least a line-contact engagement between the valve body 64 and port 54, is created at a medial point on the tapered surface portion between the tip 66 and a base portion 67. When in the closed position, the valve body to extends across the entire extent of the common exhaust passage area 58, thereby isolating the exhaust passages 18 and 20 from one another, while a tip 66 of the valve body 64 extends through port 54 into the intake manifold passage 17.

Inasmuch as the valve body 64 must fill the cross sectional extent of the exhaust passage in common portion 58 to produce isolation of the banks 18 and 20 from one another, a chamber 70 is provided on the opposite side of the exhaust passage 58 from the port 54 to allow for retraction of the valve body 64 to open the port 54, the chamber 70 extending outwardly of common area 58 to receive a base portion 72 of the valve body 64 which is tapered at a similar angle as the valve seat 57 to seal against the similarly-tapered side walls 80 of the chamber 70 when the valve 50 is in the closed position but does not interfere with sealing between the body 64 and the port 54. An end wall 74 of the chamber 70 has a throughbore 76 therein through which a stem 78 of the valve 50 extends so that, upon linear retraction of the stem 78, the valve body 64 can be drawn into the chamber 70, opening the port 54 and the exhaust passages 53, 55. It will be appreciated that when the valve is in the closed position, the force of the back pressure in the intake manifold passage and, to a small extent, the vertical component of the exhaust pressure force on the valve body act to assist in opening the valve.

The linear motion of the valve stem 78 required for operation of the valve 50 may be provided through use of any suitable actuator 80, such as, for example, a solenoid actuator or a pneumatic actuator 80. The actuator 80 may provide a fully open or a fully closed position or preferably may accommodate degrees of linear retraction and extension.

As described above, provides a number of advantages, some of which have been described above and others of which are inherent in the invention. Also, it will be apparent to those of skill in the art, upon reading the foregoing specification, that modifications can be proposed to the embodiment described without departing from the teachings herein. Accordingly, the scope of the invention should only be limited as necessitated by the accompanying claims.

What is claimed is:

1. An internal combustion engine comprising:

a plurality of cylinder banks, each bank having an exhaust manifold and an associated exhaust passage fluidly separated from an exhaust passage of another bank, and an intake manifold shared with the other bank;

an exhaust gas recirculation valve apparatus including:

a housing having separate exhaust inlet passages connected exclusively respectively at one end to each of said banks, said passages converging into a common exhaust passage in said housing, and a single outlet passage communicating with the intake manifold, and a port between said exhaust passage and said outlet passage portion of housing, said port having a tapered valve seat narrowing toward the outlet passage side thereof; and a valve member body mounted for linear movement in said housing between a closed position sealing said exhaust passage from said outlet passage and said exhaust inlet passages from each other and an open position permitting exhaust flow from both exhaust inlet passages to said outlet passage, said valve body having tapered side sealing surfaces which engage said valve seat to effect a seal therebetween, said valve body being functionally engaged to a linear actuator;

and an engine ECU operatively associated with said linear actuator to move said valve body between said open and closed positions in response to predetermined operational parameters of the engine being monitored by the ECU.

2. The internal combustion engine of claim 1 wherein valve actuation is dependent upon a comparison of a reading of at least one monitored operating parameter of the engine with values of the sensed parameter being stored in a memory of the ECU, with particular ranges of the values stored in memory being associated with a particular state of actuation for the valve.

3. The internal combustion engine of claim 1 wherein the valve body has a narrow trapezoidal cross sectional shape.

4. The internal combustion engine of claim 3 wherein an end surface of the trapezoid is a narrow rectangle end protrudes into said outlet passage in the closed position.

5. The internal combustion engine of claim 1 and said valve body being mounted to a first end of a linear stem.

6. The internal combustion engine of claim 5 and said actuator being engaged to a second end of the linear stem and being operable to cause extension and retraction of the valve body.

7. The internal combustion engine of claim 5 wherein the body of the valve is configured to extend across the entire exhaust passage when disposed in the closed position sealing said port.

8. The internal combustion engine of claim 7 wherein said housing further includes a chamber disposed adjacent said exhaust passage on the opposite side thereof from said port, said chamber being sufficiently large to receive a base portion of the valve body and to permit the valve body to retract thereinto when said valve moves to an open position.

9. The internal combustion engine of claim 8 wherein said chamber has a narrow trapezoidal cross sectional shape.

* * * * *